US005595098A

United States Patent [19]

Malkin et al.

[11] Patent Number: 5,595,098

[45] Date of Patent: Jan. 21, 1997

[54] TOOL HAVING JAWS FOR GRIPPING HEXAGONALLY SHAPED OBJECTS

[76] Inventors: Rodney Malkin, 3448 Willoughby, Holt, Mich. 48842; Gary Burgess, 3854 New Salem, Okemos, Mich. 48864

[21] Appl. No.: 361,103

[22] Filed: Dec. 21, 1994

[51] Int. Cl.[6] ..... B25B 13/16

[52] U.S. Cl. ..... 81/165; 81/170; 81/186

[58] Field of Search ..... 81/165, 186, 418–420, 81/424.5, 426, 426.5, 179, 129.5, 155, 166, 167, 170

[56] References Cited

U.S. PATENT DOCUMENTS

| | | | |
|---|---|---|---|
| 1,293,696 | 2/1919 | Bush . | |
| 2,389,933 | 11/1945 | Rober | 81/179 |
| 2,719,449 | 10/1956 | Johnson . | |
| 2,912,891 | 11/1959 | Neff . | |
| 3,283,624 | 11/1966 | Neff . | |
| 3,955,450 | 5/1976 | Evans | 81/170 |
| 3,968,708 | 7/1976 | Ingersoll . | |
| 4,011,778 | 3/1977 | Dehr | 81/186 |
| 4,437,364 | 3/1984 | Martinmaas . | |
| 4,967,613 | 11/1990 | Cone . | |
| 5,148,726 | 4/1992 | Huebscheu et al. . | |
| 5,209,144 | 5/1993 | Lu Guoji . | |
| 5,239,899 | 8/1993 | Baker . | |
| 5,305,667 | 4/1994 | Caballero . | |

FOREIGN PATENT DOCUMENTS

| | | | |
|---|---|---|---|
| 610584 | 6/1926 | France | 81/166 |

OTHER PUBLICATIONS

Spring 1985 DRI Industries Catalog Featuring 10" Long, 3–Sided Locking Heavy–Duty Adjustable Wrench, Catalog Number 1012900–A at p. 61.

*Primary Examiner*—D. S. Meislin
*Attorney, Agent, or Firm*—Niro, Scavone, Haller & Niro

[57] ABSTRACT

The invention is a tool having contoured opposing jaws for fully engaging hexagonally shaped fasteners on at least four sides for any fastener within the operating range of the tool. The jaws include a two-surfaced jaw and an opposingly disposed three-surfaced jaw. The jaw surfaces are configured and positioned relative to one another in such a way as to maintain a shape which conforms to that of the fastener's hexagonal shape during adjustment.

5 Claims, 15 Drawing Sheets

TOOL HAVING JAWS FOR GRIPPING HEXAGONALLY SHAPED OBJECTS

BACKGROUND OF THE INVENTION

1. Field of the Invention

The present invention relates to a clamping or holding apparatus having movably positionable jaws. More particularly, the present invention relates to a tool, such as a wrench, having a set of opposingly located, positionable jaws. The jaws have jaw surfaces which are uniquely configured and positioned such that the jaw surfaces may fully engage five full sides of the smallest hexagonally shaped object within the operating range of the tool and at least four full sides of subsequently larger objects within the operating range of the tool.

2. Description of Prior Art

The prior art consists of a wide variety of wrenches employing jaws in which an effort has been made to improve the tool's effectiveness in gripping standard hexagonally shaped objects, such as nuts and bolts which are commonly referred to as fasteners. For example, in U.S. Pat. No. 5,305,667 (Caballero), an adjustable wrench having movable V-shaped jaws for securing the workpiece is disclosed. (Col. 1, lines 37–47). While an improvement, this tool is primarily designed to partially engage four sides of the hexagonally shaped fastener by engaging two opposing apices of the fastener (Col. 3, lines 35–41). Because this jaw configuration only partially engages four opposing sides of a fastener at two opposite apices, unwanted rounding off of the apices can occur when sufficient torque is applied to the tool.

U.S. Pat. No. 5,239,899 (Baker) is another attempt to prevent the rounding off of the fastener's apices by providing curved drive surfaces. (Col. 2, lines 15–25). By design, the jaws of this tool do not engage the fastener's apices and are limited to engaging two opposing sides of the fastener.

SUMMARY OF THE INVENTION

This invention overcomes deficiencies in the prior art relative to the ability of the jaws to maintain sufficient contact with the available flats and apices of hexagonally shaped objects, such as fasteners, when under torque. The engagement between a tool employing the invention and the fastener is enhanced by surrounding the fastener with jaw surfaces, thereby raising the torquing capacity of the tool and improving the tool's ability to operatively engage the fastener and turn rounded, distorted and otherwise worn fasteners and prevent the rounding or distorting of fasteners or other hexagonally shaped objects.

In an embodiment of the present invention, a first jaw and second jaw, one or both of which may be movable along a linear axis, are opposingly positioned and configured to engage the sides of hexagonally shaped fasteners. The first jaw has base and extended jaw surfaces which conform to two of the fastener's sides and the second jaw has base, intermediate, and extended jaw surfaces which conform to three of the fastener's sides. The first and second jaws are configured and positioned relative to one another and the linear axis such that when the jaws are in a closed position, the jaw surfaces form a regular hexagon with one side removed. This enables the jaw surfaces to operatively engage five full sides of the smallest fastener within the operating range of the tool. Upon opening the jaws to accommodate progressively larger fasteners, four of the five jaw surfaces continue to maintain a configuration and position relative to one another and the linear axis such that the jaw surfaces maintain the ability to operatively engage at least four full sides of any subsequently larger fastener within the operating range of the tool.

In another embodiment of the present invention, the first jaw includes base, intermediate and extended jaw surfaces and the second jaw includes base and extended jaw surfaces. The positionable jaw surfaces are again uniquely configured and positioned relative to one another and the linear axis such that the jaw surfaces maintain the ability to operatively engage at least four full sides of any fastener within the operating range of the tool as the jaws are positioned to accommodate and engage progressively larger fasteners.

In yet another embodiment of the present invention, five-sided engagement of any fastener within the operating range of the tool is provided by a first primary jaw, a second primary jaw, and an auxiliary jaw. In this embodiment, the first primary jaw has base and extended jaw surfaces which conform to two of the fastener's sides and the second primary jaw has base, intermediate, and extended jaw surfaces which conform to three of the fastener's sides as previously described. The second primary jaw also includes a guide which receives a projection terminating in a jaw surface from an auxiliary jaw which extends upwardly through the guide as the jaws are opened. The positionable jaw surfaces are again uniquely configured and positioned to engage fasteners as was described above. However, by extending an auxiliary jaw surface upwardly as the second primary jaw moves away from the first primary jaw, the intermediate jaw surface, which loses the ability to engage a fastener upon opening, is replaced by the auxiliary jaw surface, thus, providing operative engagement on five sides of any fastener within the operating range of the tool.

In another embodiment in which the first primary jaw includes three jaw surfaces, five-sided engagement is again achieved by further providing a second primary jaw having two jaw surfaces and an auxiliary jaw having a jaw surface. In this embodiment, the first primary jaw includes a guide which slidingly receives the auxiliary jaw. The auxiliary jaw, again, provides a jaw surface that replaces the intermediate jaw surface which again loses the ability to engage a fastener's side as the jaws are opened.

The jaws of the various embodiments, in turn, can be attached to wide variety of tools. Tools that could be used with the present invention include wrenches having pivotally connected handles, or fixed handled wrenches, such as crescent wrenches, adjustable box wrenches, pipe wrenches or ratchet wrenches.

Accordingly, an object of the present invention is to provide a unique tool that includes a set of jaws having uniquely configured and positioned jaw surfaces which operatively engage at least four full sides of any fastener within the operating range of the tool.

Another object of the present invention is to provide a tool with the ability to turn rounded, distorted and otherwise worn fasteners and prevent the rounding or distorting of fasteners or other hexagonally shaped objects.

Another object of the present invention is to provide a tool which uses first and second primary jaws as well as an auxiliary jaw to engage five sides of any fastener within the operating range of the tool.

A further object of the invention is to provide a set of jaws that can be used on a wide variety of tools, such as wrenches having pivotally connected handles or fixed handled wrenches such as crescent, pipe, adjustable box, or ratchet wrenches.

DESCRIPTION OF THE PREFERRED EMBODIMENTS

Figure 1:
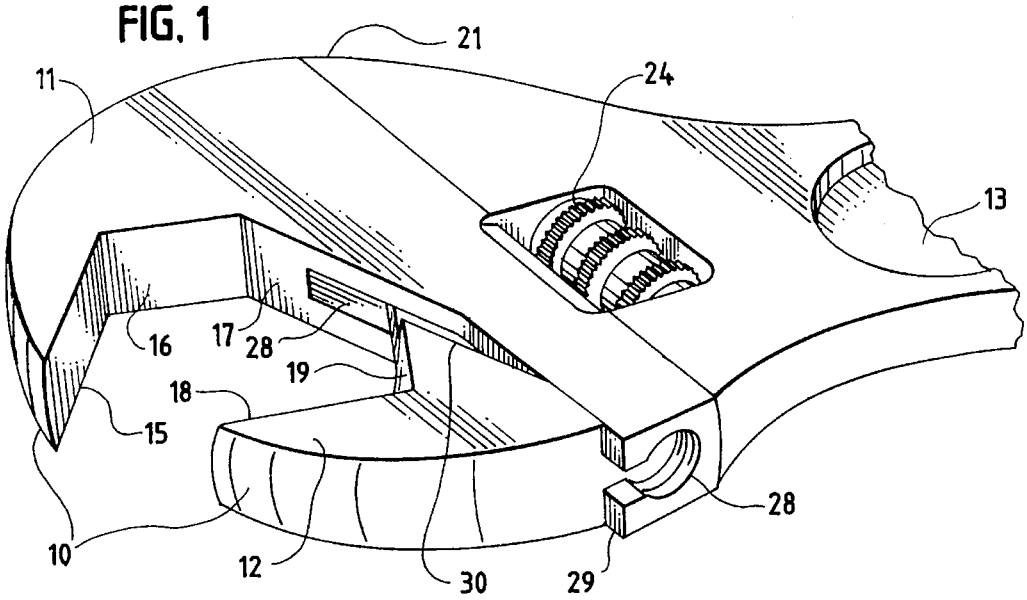
FIG. 1 is a perspective view of an embodiment of the invention showing a first jaw having three jaw surfaces and a second jaw having two jaw surfaces.
Figure 2:
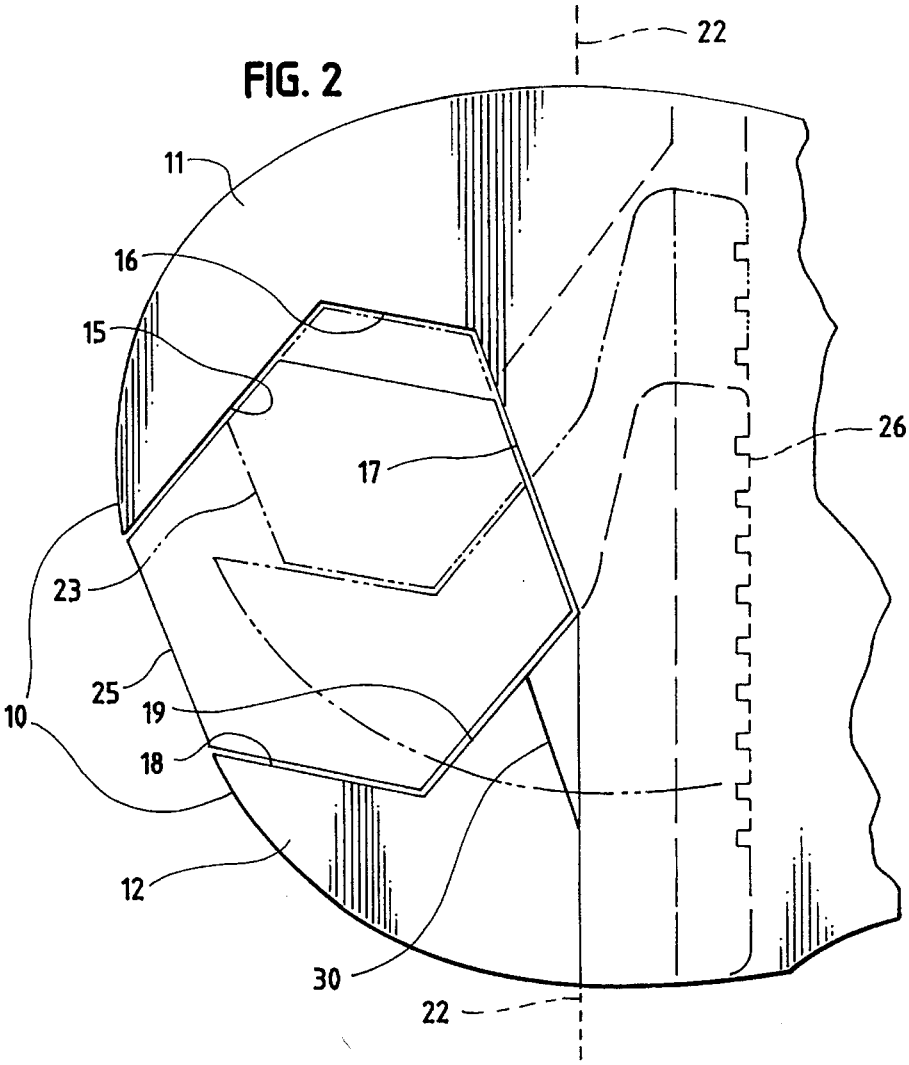
FIG. 2 is an orthographic view of the embodiment shown in FIG. 1 illustrating the ability of the jaws to accommodate and operatively engage at least four full sides of any hexagonally shaped object within the tool's operating range.
Figure 3:
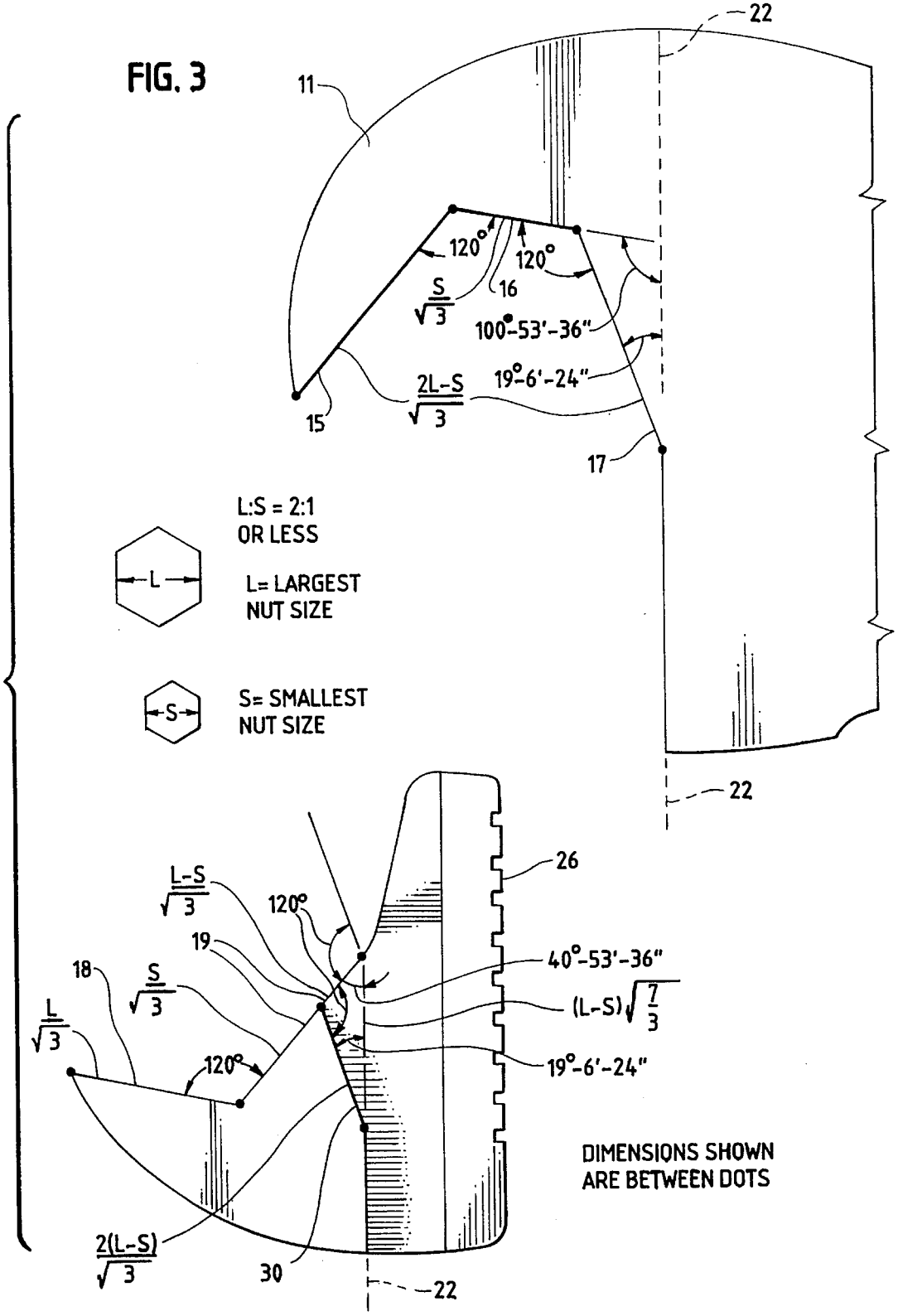
FIG. 3 is a dimensional drawing of the embodiment shown in FIG. 1.

With reference to FIGS. 1 through 3, a preferred embodiment of the present invention consists of a tool having a set of positionable jaws 10 which are configured for use with a wide variety of wrenches which can produce parallel movement, such as wrenches having pivotally connected handles or fixed handled wrenches having adjusting means such as those used with crescent, pipe, adjustable box and ratchet wrenches. When jaws 10 are combined with a wrench handle 13, a tool 21 for engaging hexagonally shaped objects, such as fasteners.

Jaws 10 include first jaw 11 which is integral with handle 13. First jaw 11, which is also an upper jaw in this embodiment, further includes extended jaw surface 15, intermediate jaw surface 16 and base jaw surface 17 which are angularly disposed at angles of 120 degrees for engaging hexagonally shaped objects as shown in FIG. 3.

Opposingly positioned from first jaw 11 is second jaw 12 which includes extended jaw surface 18 and base jaw surface 19 which are also angularly disposed at an angle of 120 degrees for engaging hexagonally shaped objects as shown in FIG. 3. Because the surfaces of the jaws are designed to primarily engage fasteners, they can be either flat or serrated.

Jaws 10 accommodate and operatively engage increasingly larger fasteners by adjustingly positioning second jaw 12 in relationship to first jaw 11 along linear axis 22 by the use of an adjusting worm 24 located in handle 13. Worm 24 engages rack 26 of second jaw 12 which is slidably received and positioned by guide slot 28 and end wall 29 of handle 13. This wrench assembly, which is commonly known as a crescent wrench, then operates in a manner indicated in U.S. Pat. No. 3,969,708 which is incorporated herein by reference. Of course, persons of ordinary skill in the art would recognize that other wrenches employing different adjusting means which can movably position the jaws along a linear axis may also be used with the present invention, some of which will be described below.

As shown in FIG. 3, jaws 10 are configured and positioned relative to linear axis 22 as follows: base surface 17, 19 degrees 6 minutes and 24 seconds; intermediate surface 16, 100 degrees 53 minutes and 36 seconds; and base surface 19, 40 degrees 53 minutes and 36 seconds. Extended jaw surfaces 15 and 18 may then be configured and positioned at 120 degrees relative to jaw surfaces 16 and 19, respectively. Moreover, while the above mentioned angles produce optimal results, variations of about two to three degrees in the angulation would still produce a workable set of jaws which would be within the scope of the present invention.

As demonstrated in FIG. 2, by aligning the jaws as described above, jaws 10 are able to operatively engage five full sides of the smallest fastener 23 within the operating range of the tool and at least four full sides of any progressively larger fastener up to the largest fastener 25 within the operating range of the tool. Hereinafter, full engagement of a fastener's side means contact along the entire side between adjacent apices. In other words, the jaws are able to continuously maintain contact with a fastener's side from apex to apex. However, as shown in FIG. 1, the formation of relief 30 requires that a portion of surface 19 be narrower than the other jaw surfaces which prevents surface 19 from being able to fully engage the entire thickness of a fastener in which the width of the fastener exceeds the width of the narrowed portion. Consequently, full sided engagement does not mean maintaining continuous contact along a fastener's thickness or side as measured from top to bottom. Surface 16, however, will not be able to maintain engagement with a fastener side upon the opening of the jaws. As further demonstrated in FIG. 2, the fastener sides engaged by the jaw surfaces include three adjacent sides which are engaged by surfaces 17, 18, and 19 and an opposing fastener side which is engaged by surface 15. Gripping a hexagonal object in this manner helps prevent slippage and stripping since the object is wedged into the jaw surfaces thereby helping to maintain the shape of the object.

To ensure proper engagement, jaw surfaces 15–19 should be dimensioned as shown in FIG. 3, where "L" is the is the largest size and "S" is the smallest size object which can be used within the operating range of the tool. As shown, the lengths of jaw surfaces 15–19 should be as follows: surfaces 15 and 17, 2L-S divided by the square root of three; surface 16, S divided by the square root of three; surfaces 18 and 19, L divided by the square root of three.

As shown in FIGS. 1 though 3, a portion of jaw 12 is made to be slidably engagable with guide slot 28 by reducing the thickness of a portion of jaw 12 to a corresponding size which will fit within guide slot 28. As shown in FIG. 3, this thickness persists up to a relief 30 with a length of 2(L-S) divided by the square root of three and positioned relative to axis 22 at an angle of about 19 degrees 6 minutes and 24 seconds. By configuring the jaws in this manner, an operating range where "L" may be twice the size of "S" is achieved.

Figure 4:
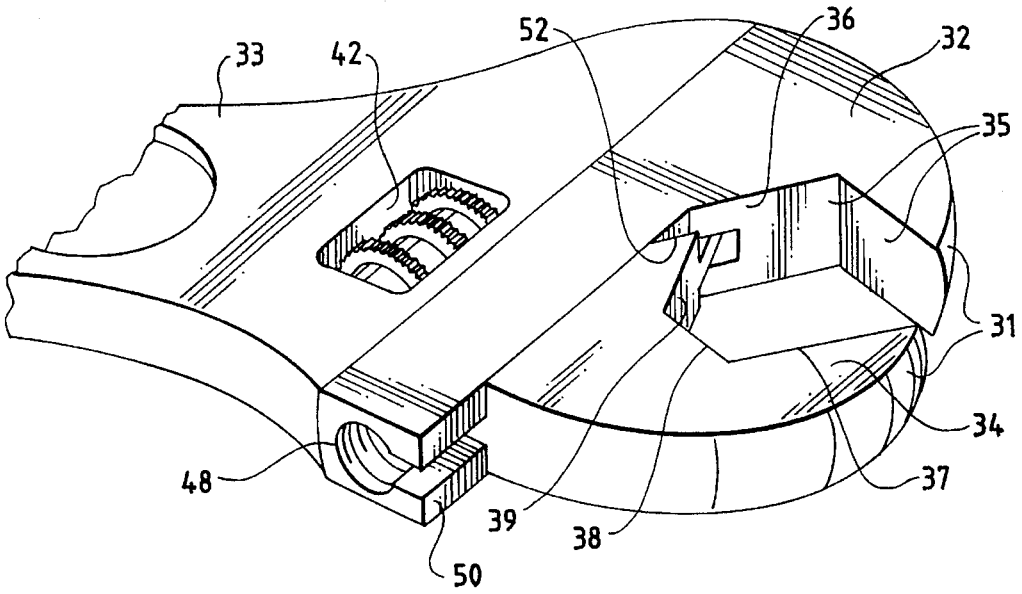
FIG. 4 is a perspective view of an embodiment of the invention having a first jaw having two jaw surfaces and a second jaw having three jaw surfaces.
Figure 5:
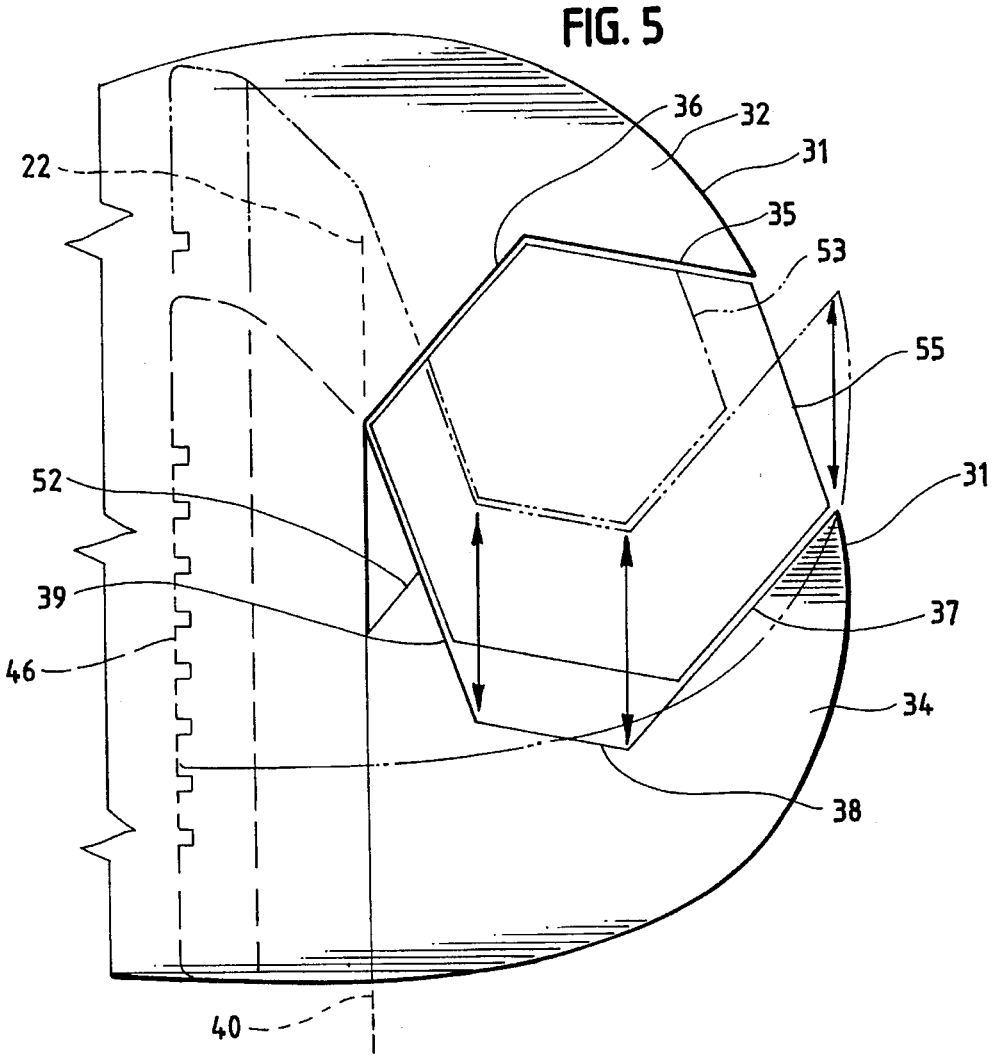
FIG. 5 is an orthographic view of the embodiment shown in FIG. 4 illustrating the ability of the jaws to accommodate and engage at least four full sides of any hexagonally shaped object within the tool's operating range.
Figure 6:
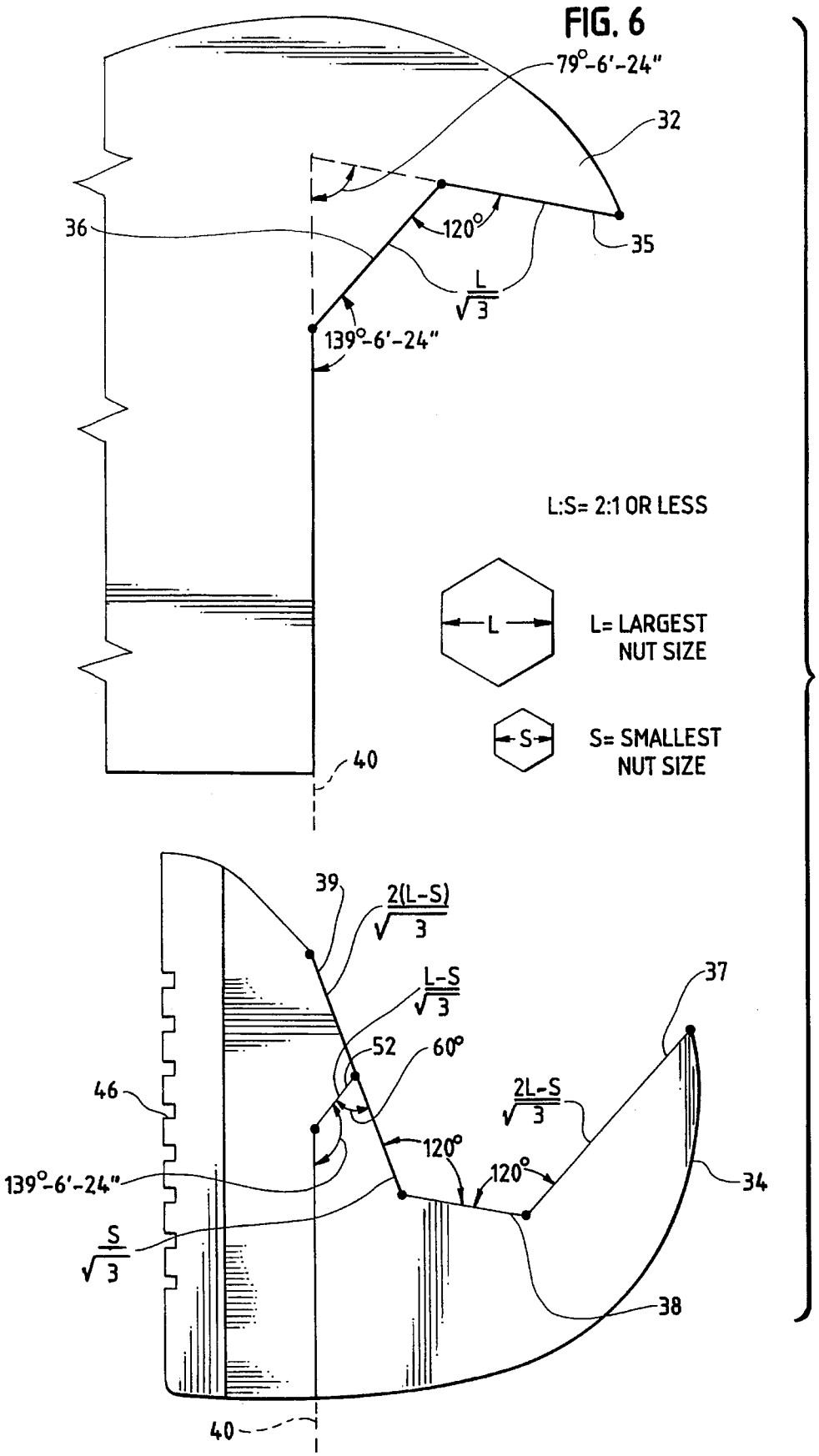
FIG. 6 is a dimensional drawing of the embodiment shown in FIG. 4.

As shown in FIGS. 4 through 6, another embodiment of the present invention includes a set of positionable jaws 31 where first jaw 32 includes two jaw surfaces and second jaw 34 includes three jaw surfaces, both of which may be adapted to work with the adjustment mechanism of a crescent wrench as well as other wrenches as those of ordinary skill in the art would appreciate. First jaw 32, which is also an upper jaw in this embodiment, is integral with handle 33 and includes extended jaw surface 35 and base jaw surface 36 which are angularly disposed at an angle of 120 degrees for operatively engaging hexagonally shaped objects, such as fasteners, as shown in FIG. 6. Opposingly positioned second jaw 34 includes extended jaw surface 37, intermediate jaw surface 38 and base jaw surface 39 which are angularly disposed at angles of 120 degrees for operatively engaging hexagonally shaped objects as shown in FIG. 6. Because the jaw surfaces are designed to primarily engage fasteners, they can be either flat or serrated.

Jaws 31 accommodate and operatively engage increasingly larger fasteners by adjustingly positioning second jaw 34 in relationship to first jaw 32 along linear axis 40 by the use of an adjusting worm 42 located in handle 33. Worm 42 engages rack 46 of second jaw 34 which is slidably received and positioned by guide slot 48 and end wall 50 of handle 33. This embodiment then operate as was described above.

As shown in FIG. 6, the jaw surfaces are positioned and configured relative to linear axis 40 as follows: extended jaw surface 35, 79 degrees 6 minutes and 24 seconds; base jaw surface 36, 139 degrees 6 minutes and 24 seconds; and base jaw surface 39, 19 degrees 6 minutes and 24 seconds. The other jaw surfaces may then be positioned accordingly. While the above referenced angles produce optimal results, variations of about two to three degrees in the angulation would still produced a workable set of jaws which would be within the scope of the present invention.

As demonstrated in FIG. 5, by aligning the jaw surfaces as described above, jaws 31 are able to operatively engage five full sides of the smallest fastener 53 within the operating range of the tool and at least four full sides of any progressively larger fastener up to the largest fastener 55 within the operating range of the tool. Intermediate jaw surface 38, however, will not be able to maintain contact with a side of a fastener upon the opening of the jaws.

To ensure proper engagement, the lengths of surfaces 35–39 should be dimensioned as shown in FIG. 6, where "L" is the is the largest size and "S" is the smallest size fastener which can be used within the operating range of the tool. As shown, the lengths of surfaces 35–39 should be as follows: surfaces 35 and 36, L divided by the square root of three; surface 38, S divided by the square root of three; surfaces 37 and 39, 2L-S divided by the square root of three.

As shown in FIGS. 4 through 6, a portion of jaw 34 is made to be slidably engagable with guide slot 48 by reducing the thickness of a portion of jaw 34 to a corresponding size which will fit within guide slot 48. As shown in FIG. 6, this thickness persists up to a relief 52 with a length of L-S divided by the square root of three and positioned relative to axis 40 at an angle of about 139 degrees 6 minutes and 24 seconds. By configuring the jaws in this manner, an operating range where "L" may be twice the size of "S" is achieved.

Figure 7:
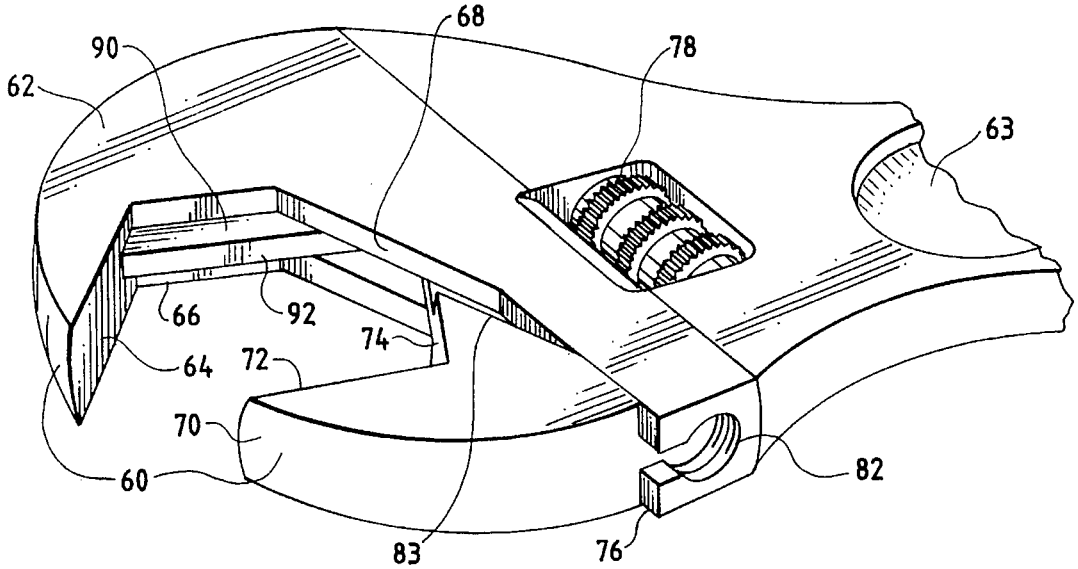
FIG. 7 is a perspective view of an embodiment comprising a first primary jaw having three jaw surfaces, a second primary jaw having two jaw surfaces, and an auxiliary jaw having a jaw surface, all of which provide five sided engagement with any fastener within the operating range of the tool.
Figure 8:
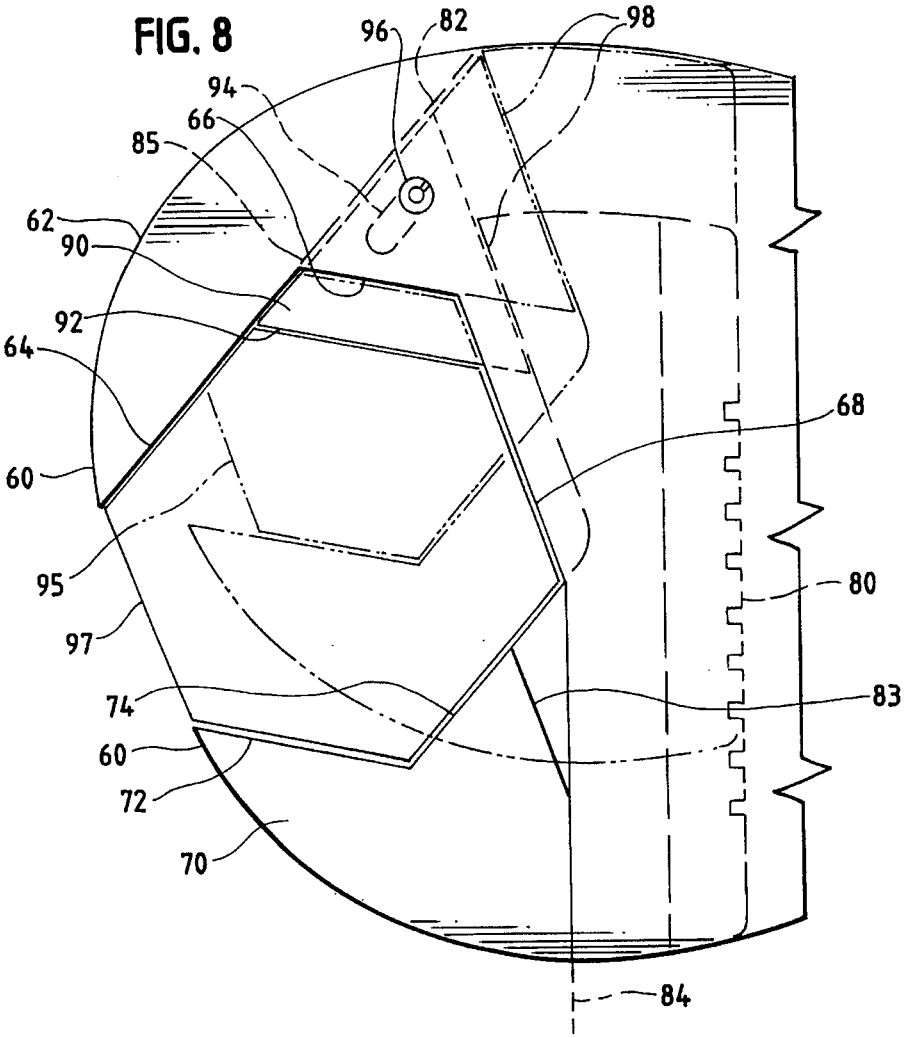
FIG. 8 is an orthographic view of the embodiment shown in FIG. 7 illustrating the ability of the jaws to accommodate and engage five sides of any hexagonally shaped object with the tool's operating range.
Figure 9:
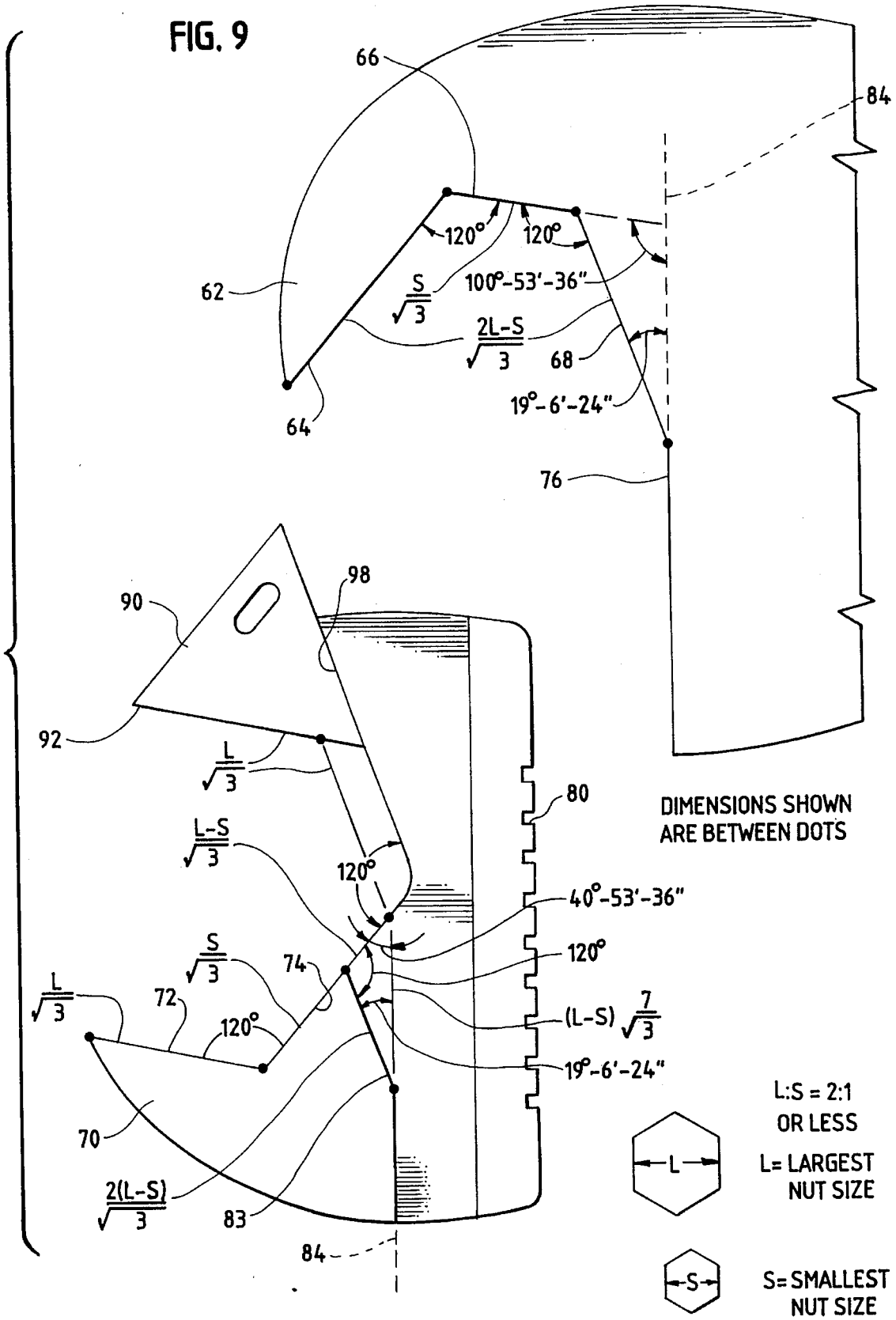
FIG. 9 is a dimensional drawing of the embodiment shown in FIG. 7.

As shown in FIGS. 7 through 9, another embodiment based upon the embodiment shown in FIGS. 1 through 3, provides positionable jaws 60 which operatively engage five full sides of any hexagonally shaped object, such as fasteners, within the operating range of the tool. This embodiment includes a first primary jaw 62 which is integral with handle 63 and includes extended jaw surface 64, intermediate jaw surface 66, and base jaw surface 68, which are angularly disposed at angles of 120 degrees for engaging hexagonally shaped objects as was described above and as shown in FIG. 9.

Opposingly positioned from jaw 62 on handle 63 is second primary jaw 70 which includes extended jaw surface 72 and base jaw surface 74 which are also angularly disposed at an angle of 120 degrees as shown in FIG. 9. Because the jaw surfaces are designed to primarily engage fasteners, they can be either flat or serrated.

As demonstrated in FIG. 8, jaws 60 are able to accommodate and operatively engage the smallest fastener 95 and any progressively larger fasteners up to the largest fastener 97 within the operating range of the tool by adjustingly positioning jaw 70 in relationship to jaw 62 along linear axis 84. One manner in which the jaws may be positioned is by the use of an adjusting worm 78 located in handle 63. Worm 78 engages rack 80 of jaw 70 which is slidably received and positioned by guide 82 and end wall 76 of handle 63. This assembly then operates as previously described. Moreover, as shown in FIG. 9, the angulations of the jaw surfaces with respect to linear axis 84 and the lengths of the jaw surfaces, as well as the use of a relief 83 is the same as described for the embodiment shown in FIGS. 1 through 3.

However, to enable this embodiment to operatively engage five sides of any fastener within the operating range of the tool, the embodiment has been modified to include a triangularly shaped auxiliary jaw 90 having a jaw surface 92. Jaw 90 is slidably received within guide 82 which, for this embodiment, extends up into jaw 62 and terminates in guide edge 85 which is in alignment with surface 64 as shown in FIG. 8. A guide bore 94 in auxiliary jaw 90 is also provided, which, when intersected by retention pin 96, holds jaw 90 in place within guide 82.

Jaw 70 has also been adapted to include projection 98 which fits within guide 82 and engages one side of auxiliary jaw 90. As shown in FIG. 8, projection 98, guide bore 94, and jaw 90 are configured such that when jaws 60 are in a closed position, jaw surface 92 is flush with jaw surface 66 and five sides of the smallest fastener 95 within the operating range of the tool are engaged. Then as jaws 60 are positioned to engage larger fasteners, jaw surface 92 replaces jaw surface 66, which typically loses the ability to engage progressively larger fasteners once the jaws are opened, thereby maintaining the tool's ability to engage five sides of any subsequently larger fastener up to the largest fastener 97 within the operating range of the tool.

As shown in FIGS. 8 and 9, the ability to maintain full engagement for all fasteners within the tool's operating range is accomplished by angularly disposing projection 98 at an angle of 120 degrees with respect to jaw surface 74 so that as second jaw 70 is positioned in relationship to jaw 62, projection 98 engages auxiliary jaw 90 and pushes it downwardly. Jaw 90 is kept in position by having another one of its sides move along guide edge 85 and by the movement of guide bore 94 along pin 96. As further illustrated in FIG. 9, to ensure proper engagement, jaw surface 92 should reach a length equal to L divided by the square root of three when jaws 60 are in a fully opened position and where L is the largest fastener size within the operating range of the tool as was described above.

Figure 10:
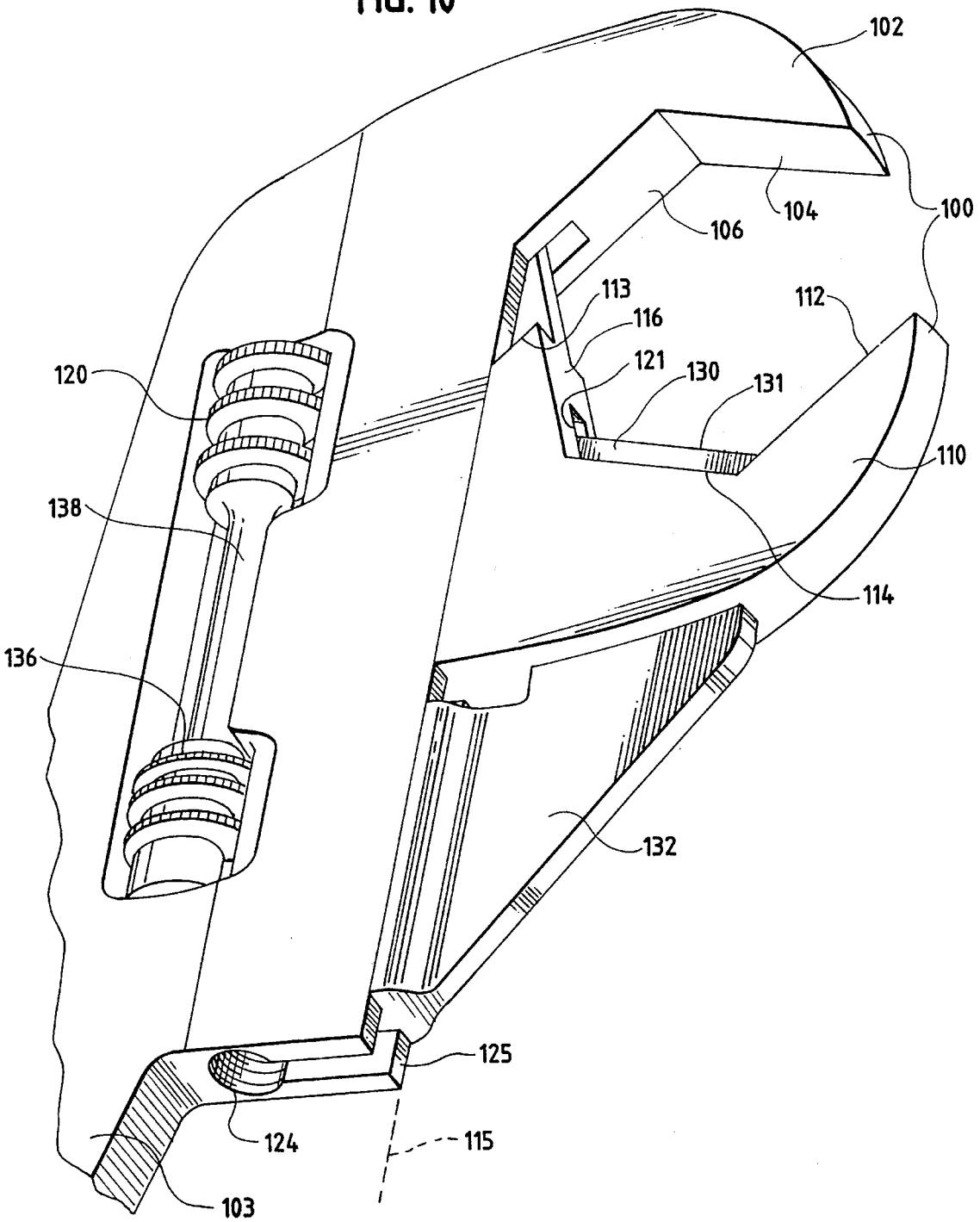
FIG. 10 is a perspective view of an embodiment comprising a first primary jaw having two jaw surfaces, a second primary jaw having three jaw surfaces and an auxiliary jaw having a jaw surface, all of which provide five-sided engagement with any object within the tool's operating range.
Figure 11:
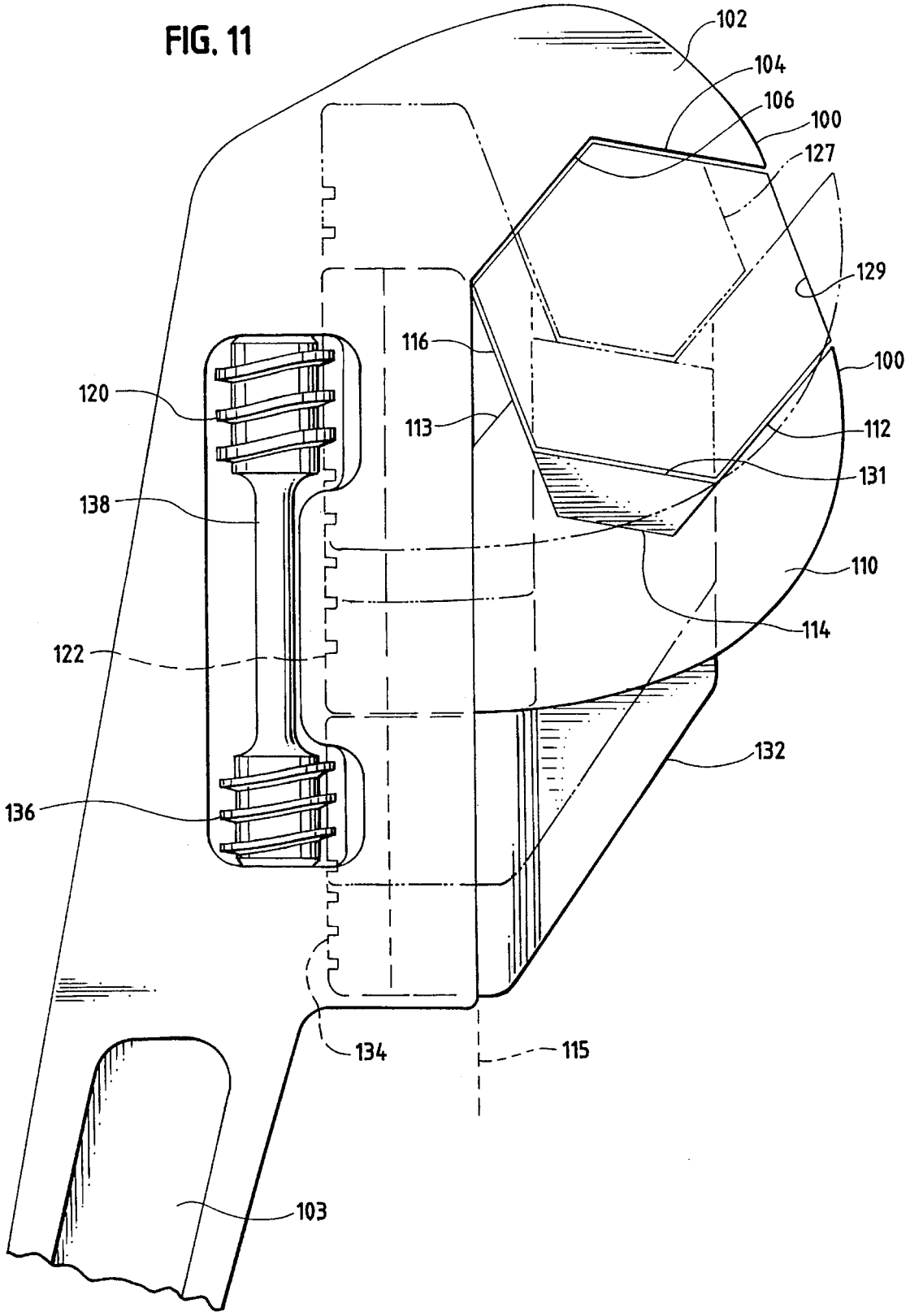
FIG. 11 is an orthographic view of the embodiment shown in FIG. 10 illustrating the jaws ability to accommodate and engage hexagonally shaped objects with the tool's operating range.
Figure 12:
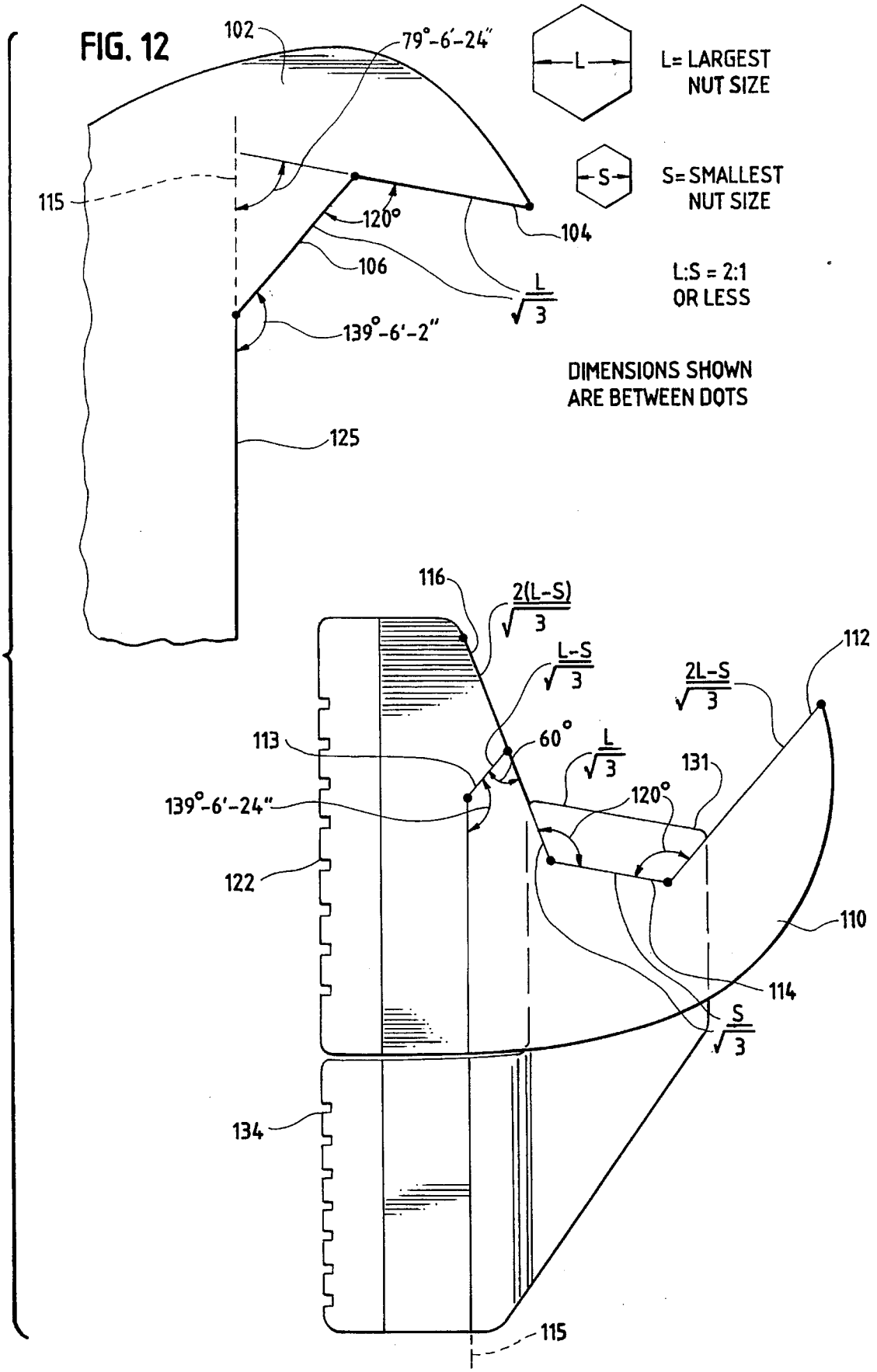
FIG. 12 is a dimensional drawing of the embodiment shown in FIG. 10.

FIGS. 10 through 12 illustrate another embodiment having jaws 100 which is based upon the embodiment shown in FIGS. 4 through 6. This embodiment includes positionable jaws 100 which have the ability to accommodate and operatively engage five sides of any fastener within the operating range of the tool. This embodiment includes a first primary jaw 102 which is integral with handle 103. Jaw 102 includes extended jaw surface 104 and base jaw surface 106 which are angularly disposed at an angle of 120 degrees for engaging fasteners as shown in FIG. 12.

Opposingly positioned second primary jaw 110 includes extended jaw surface 112, intermediate jaw surface 114 and base jaw surface 116 which are angularly disposed at angles of 120 degrees for engaging hexagonally shaped fasteners as also shown in FIG. 12. The jaw surfaces can be either flat or serrated.

As demonstrated in FIG. 11, jaws 100 have the ability to accommodate and operatively engage increasingly larger fasteners by adjustably positioning second primary jaw 110 in relationship to first primary jaw 102 along linear axis 115. One manner in which the jaws may be positioned is by the use of an adjusting worm 120 located in handle 103. Worm 120 engages rack 122 of jaw 110 which is slidably received and positioned by guide 124 and end wall 125 of handle 103. This assembly then operates in a manner as previously described. Moreover, the angulations of the jaw surfaces with respect to linear axis 115 and the lengths of the jaw surfaces, as well as the use of a relief 113 is the same as described for the embodiment shown in FIGS. 4 through 6 and is illustrated in FIG. 12.

To enable this embodiment to operatively engage five full sides of any fastener within the operating range of the tool, second primary jaw 110 has been modified to include second guide 121 which receives a projection 130 having jaw surface 131 from auxiliary jaw 132. Auxiliary jaw 132 further includes rack 134 which is also slidably received and positioned by guide 124 and end wall 125 of handle 103. Rack 134 interacts with second worm 136 which is connected to worm 120 by shaft 138.

As demonstrated in FIG. 11, when jaws 100 are in a closed position, jaw surface 131 is flush with jaw surface 114 and five full sides of the smallest fastener 127 within the operating range of the tool are engaged. Then as jaws 100 are positioned to accommodate and operatively engage progressively larger fasteners, jaw surface 131 replaces jaw surface 114, which typically loses the ability to engage a fastener once the jaws are opened, thereby maintaining the tool's ability to engage five sides of any subsequently larger fastener up to the largest fastener 129 within the operating range of the tool.

This is accomplished by having auxiliary jaw 132 move at a slower rate than second primary jaw 110. To synchronize the movement of jaws 110 and 132 it has been found that the number of teeth per inch on rack 134 should be 1.5 times the number of teeth per inch on rack 122 and worms 120 and 136 should also be modified accordingly. As shown in FIG. 12, to ensure proper coverage of a fastener's side, jaw surface 131 should reach a length equal to L divided by the square root of three when jaws 100 are in a fully opened position and where L is the largest fastener size within the operating range of the tool as previously described.

Figure 13:
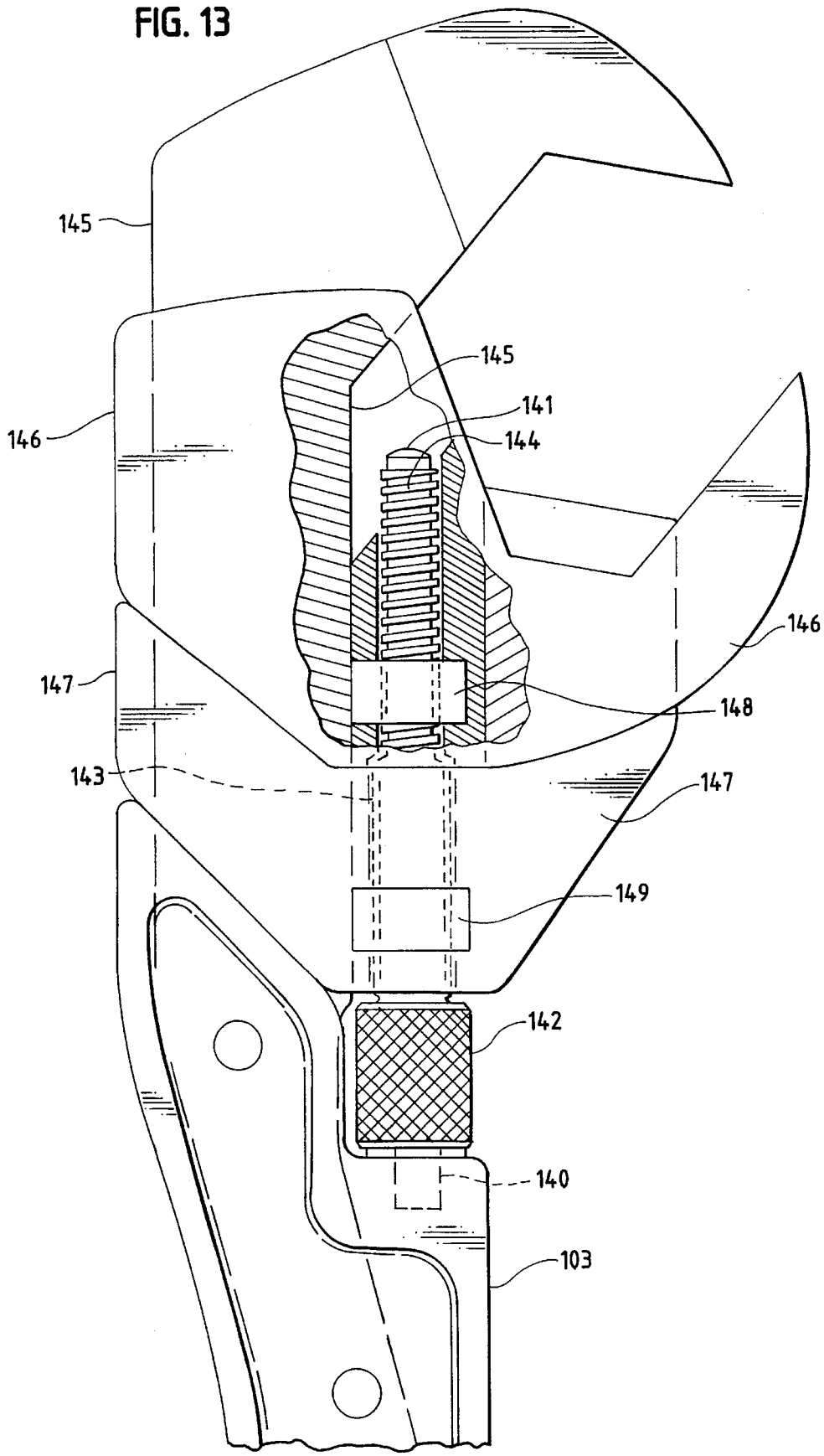
FIG. 13 is a perspective view of an embodiment of the present invention, with portions removed to reveal aspects of the invention, adapted for use with a tool employing an adjusting screw to position the jaws.

As shown in FIG. 13, the embodiment illustrated in Figures 10 through 12 can alternately be adjustingly positioned by adapting handle 103 to include bore 140 which retains adjustment screw 141 having a head portion 142 and threaded portions 143 and 144. Handle 103 further includes guide 145 which slidably retains and positions jaws 146 and 147 which are adjustingly connected to thread portions 143 and 144 by correspondingly positioned internally threaded fasteners 148 and 149.

The jaws are then adjusted by rotating head portion 142 of screw 141, which causes jaws 146 and 147 to move in a cooperating manner. As was described above, movement of the jaws should be synchronized so that jaw 147 moves at a slower rate than jaw 146. This is again accomplished by having threaded portion 143 contain 1.5 times as many threads per inch than portion 144. Persons of ordinary skill in the art would also recognize that the other embodiments illustrated above could also be adjustingly positioned in this manner as well.

Figure 14:
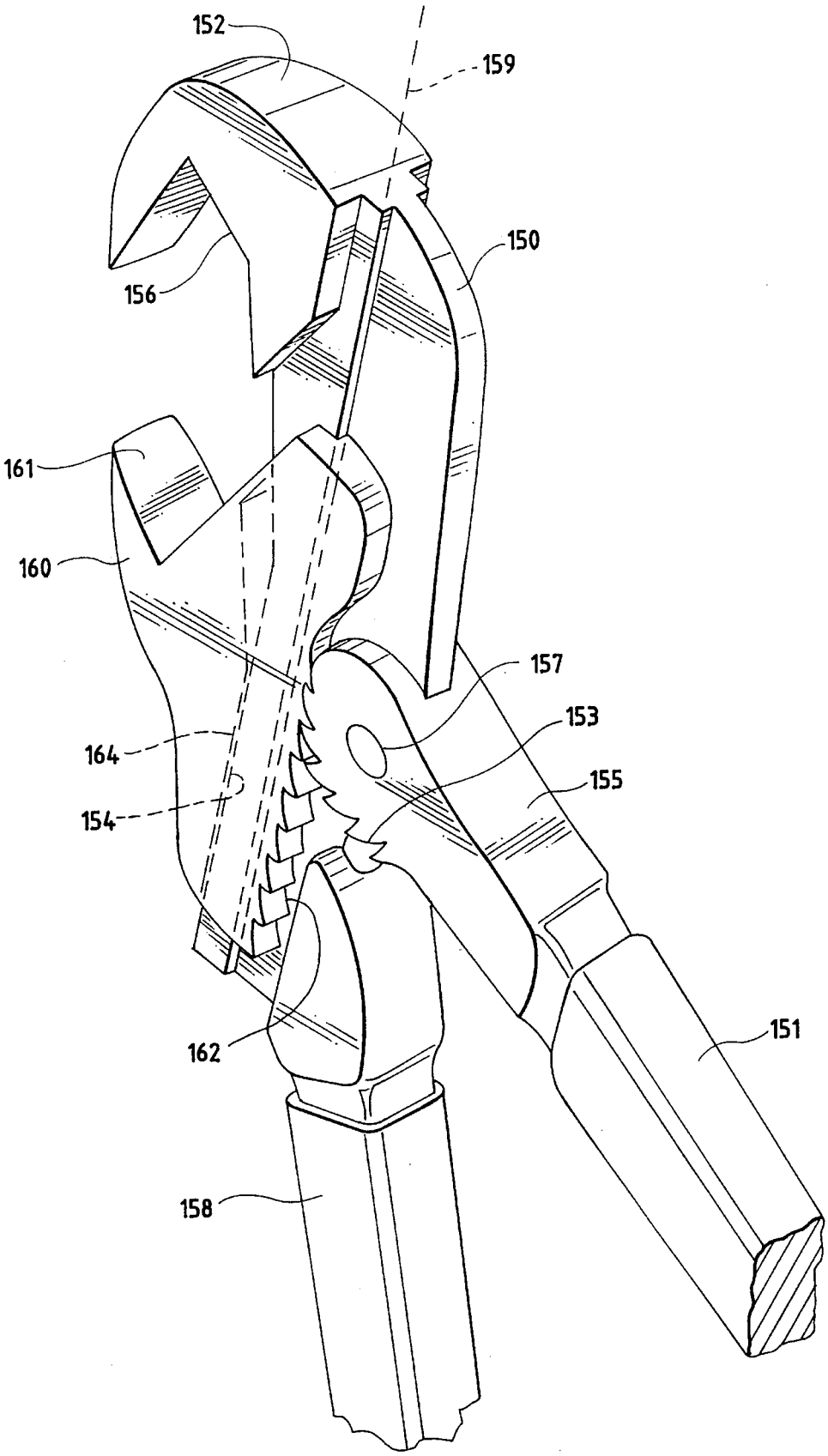
FIG. 14 is a perspective view of an embodiment of the present invention adapted to work with a set of pivoting handles.

FIG. 14 illustrates an embodiment of the invention in which pivoting tool handles have been adapted for use with the jaws of the present invention. This embodiment includes a wrench head 150 including first jaw 152, jaw surfaces 156, first guide 154, pivot pin 157, and integral handle 158. Also provided is second jaw 160 having jaw surfaces 161, rack 162 and second guide 164 which is adapted to cooperate and mate with first guide 154 such that jaw 160 is slidably retained in a linear relationship to first jaw 152 along an axis 159. The jaws are adjustingly positioned by the use of a second pivoting handle 151 which is rotatably mounted to pin 157, and further includes gear teeth 153 located on head portion 155 which engage rack 162. So long as jaw surfaces 156 and 161 are configured and positioned relative to one another and linear axis 159 in accordance with the angulations and dimensions described above, first jaw 152 may employ either two or three jaw surfaces and second jaw 160 may employ two or three jaw surfaces, respectively and full engagement with at least four sides of any fastener within the operating range of the tool will be provided. This assembly then operates in a manner described in U.S. Pat. No. 3,283,624 which is incorporated herein by reference.

Figure 15:
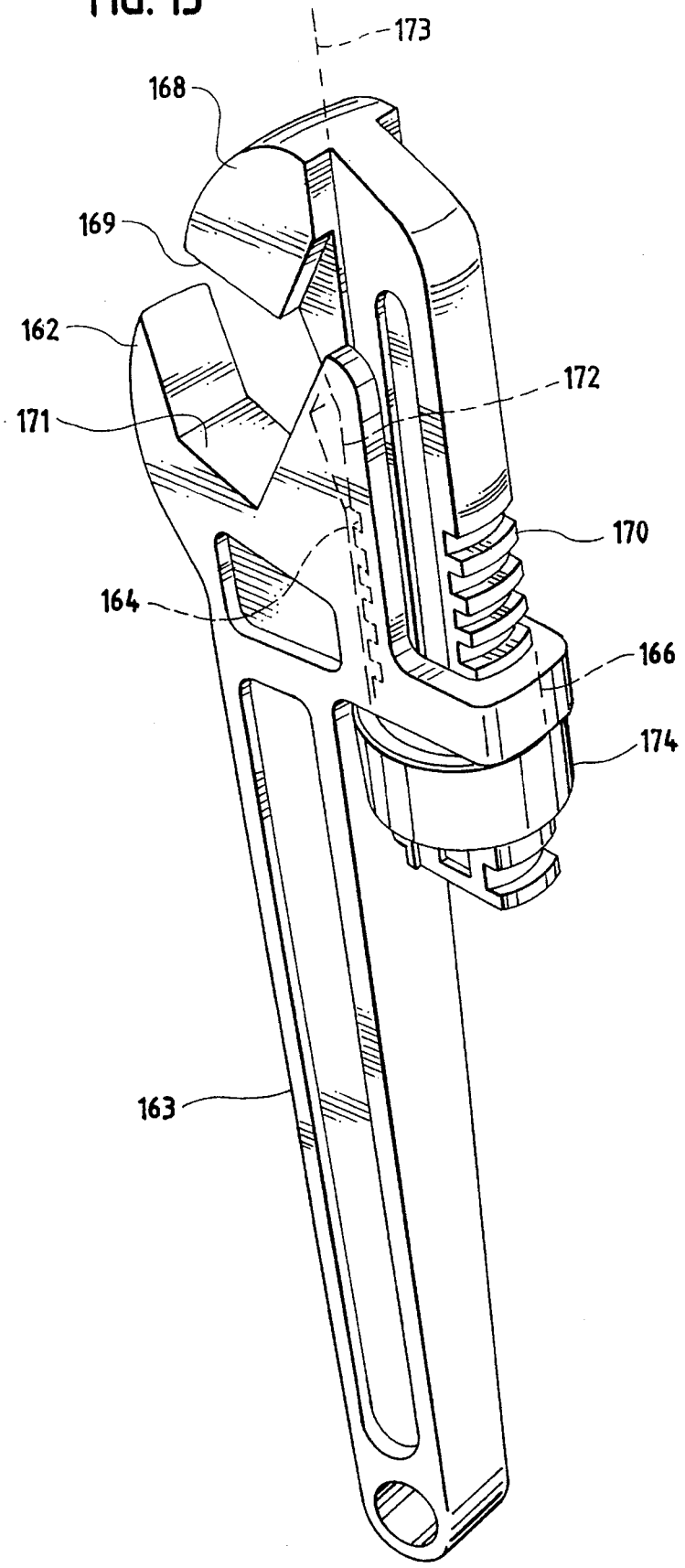
FIG. 15 is a perspective view of an embodiment of the present invention adapted for use with a wrench configuration commonly known as a pipe wrench.

FIG. 15 illustrates yet another embodiment of the present invention, based upon a wrench commonly known as a pipe wrench. This embodiment also provides a pair of positionable jaws which engage five sides of the smallest fastener within the operating range of the tool and at least four sides of any subsequently larger fastener within the operating range of the tool.

This embodiment includes handle 163 having integral first jaw 165 having jaw surfaces 171, first guide 167, and bore 166. Second jaw 168 having jaw surfaces 169 is provided which terminates in threaded shank 170 and is slidably received and retained in position relative to jaw 162 along linear axis 173 by second guide 172 which cooperates and mates with first guide 167. First jaw 162 may include either two or three jaw surfaces and second jaw 168 either three or two jaw surfaces, respectively. Full engagement will be provided so long as jaw surfaces 169 and 171 are configured and positioned relative to one another and linear axis 173 according to the angulations and dimensions described above.

Adjustment is provided by inserting threaded shank 170 through bore 166 and attaching adjusting nut 174. The rotation of nut 174 and its interaction with threads 170 and bore 166 allow the jaws to be positioned as desired.

Figure 16:
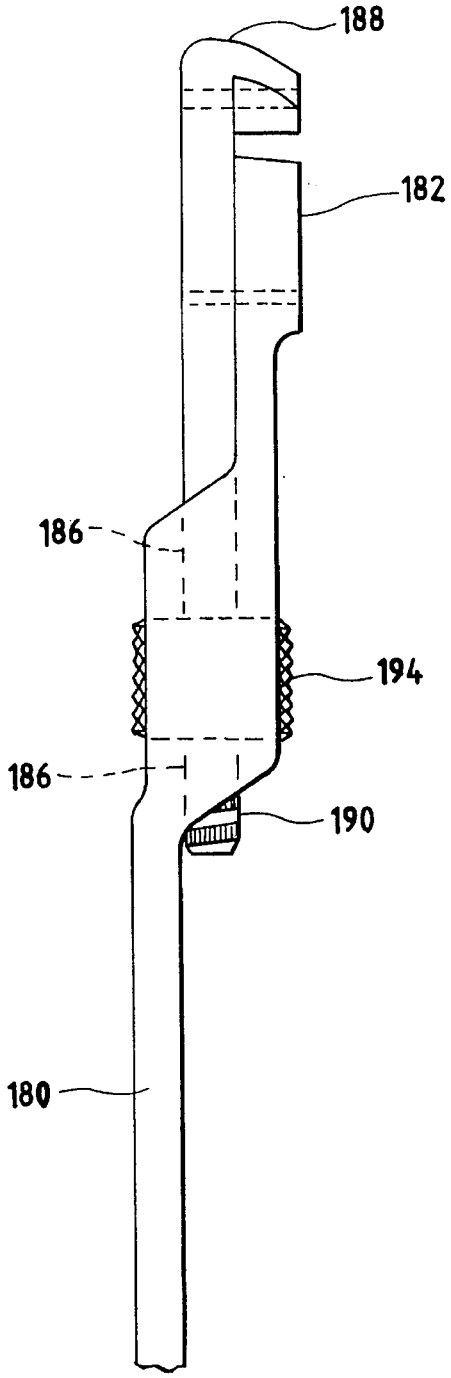
FIG. 16 is side view of an embodiment of the present invention adapted to work as an adjustable box wrench.
Figure 17:
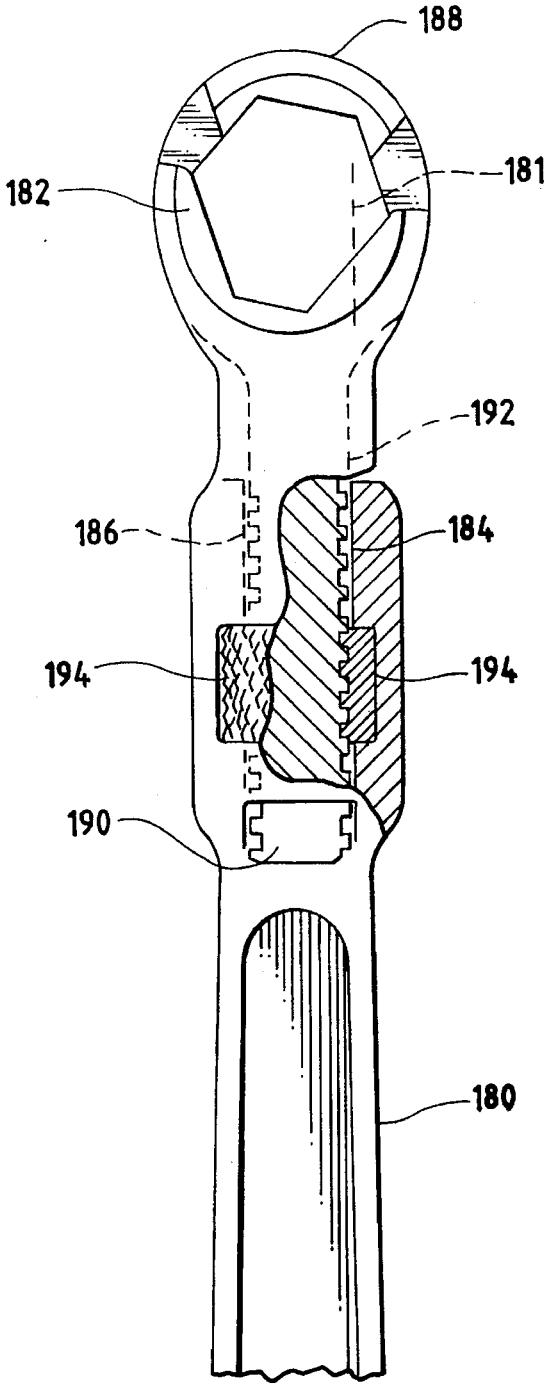
FIG. 17 is top view the embodiment shown in FIG. 16 with portions removed to reveal aspects of the invention.

Another embodiment of the present invention which has been adapted for use as an adjustable box wrench is illustrated in FIGS. 16 and 17. The design of this embodiment is similar to the designs disclosed in U.S. Pat. Nos. 2,912,891 and 4,967,613 which are herein incorporated by reference. This embodiment incudes fixed handle 180 having integral first jaw 182, first guide 184, and bore 186. Second jaw 188 is provided which terminates in threaded shank 190 and is slidably received and retained in position relative to jaw 182 by second guide 192 which cooperates and mates with first guide 184. First jaw 182 may include either two or three jaw surfaces and second jaw 188 either three or two jaw surfaces, respectively and full engagement of at least four sides of any fastener within the operating range of the tool will be provided so long as the jaw surfaces are configured and positioned relative to one another and linear axis 181 in accordance with the previously described angulations and dimensions.

Figure 18:
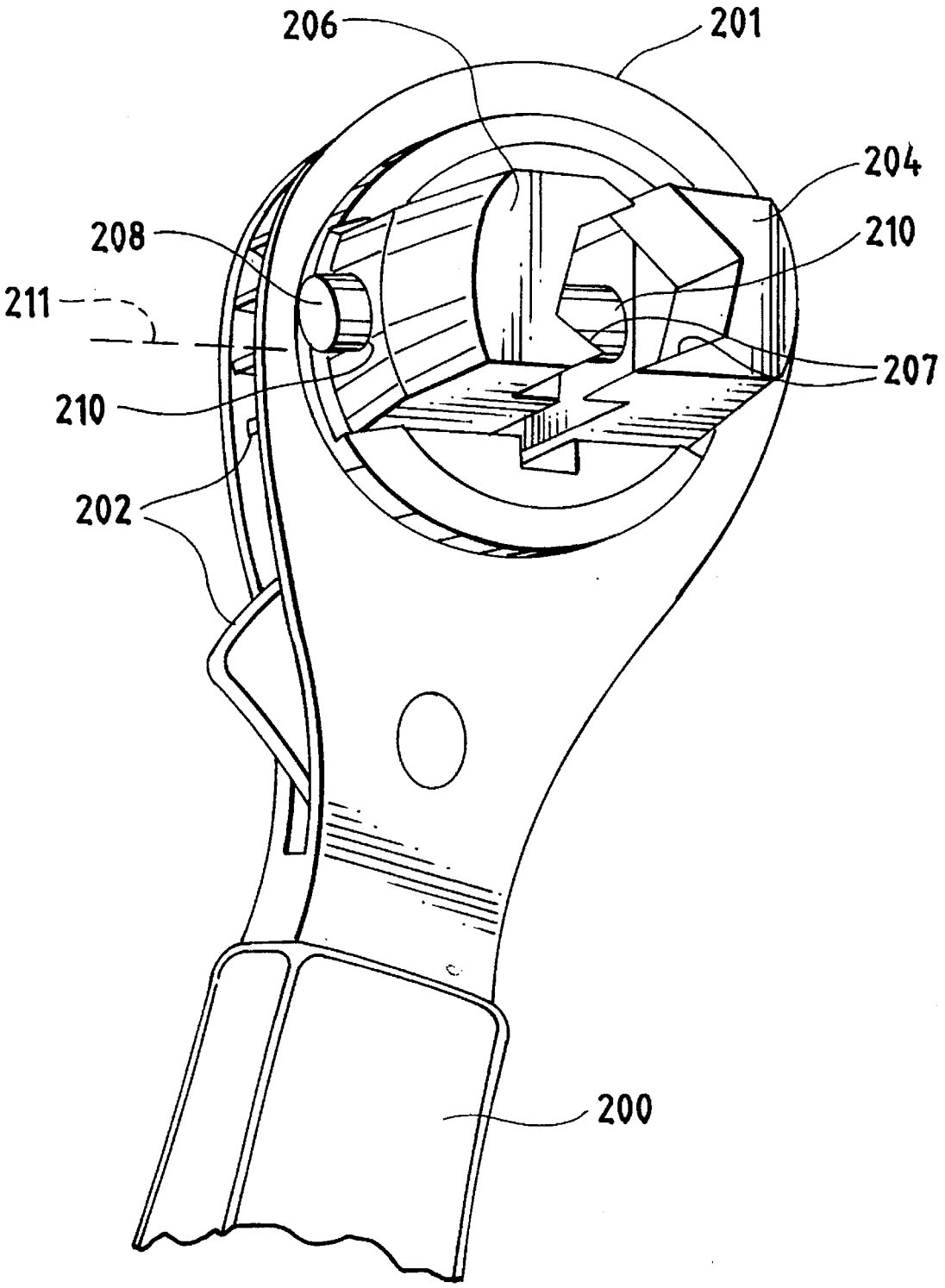
FIG. 18 is a perspective view of an embodiment of the present invention adapted for use as an adjustable ratchet wrench.
Figure 19:
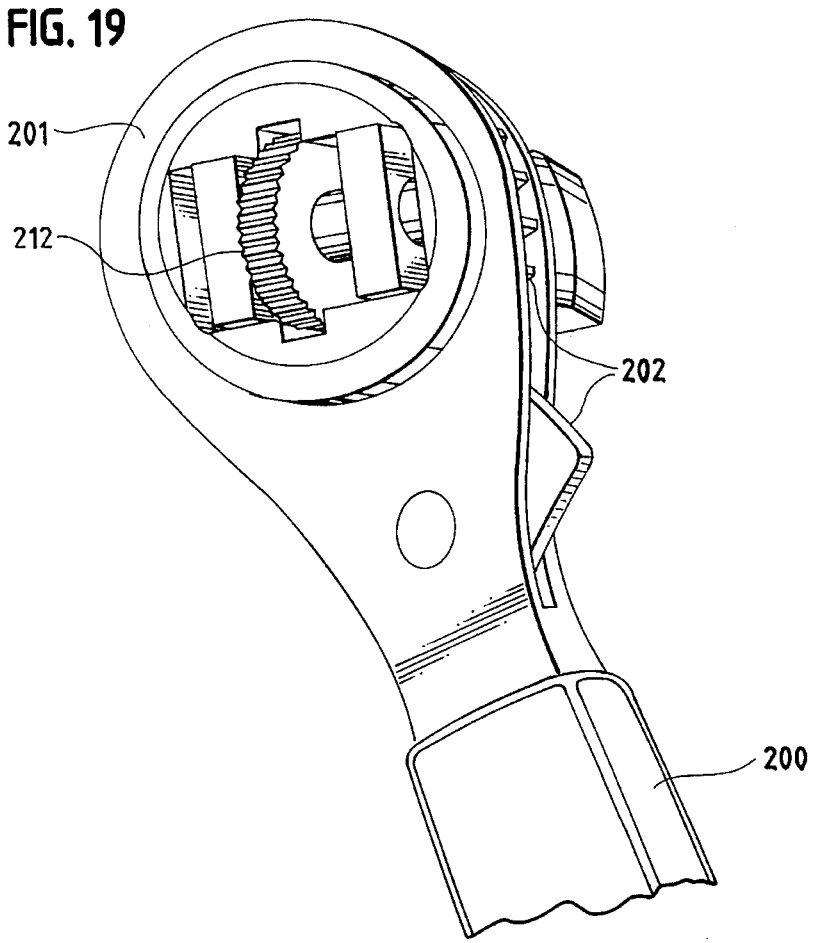
FIG. 19 is top view of the embodiment shown in FIG. 18 showing the thumb wheel used to position the jaws.
Figure 20:
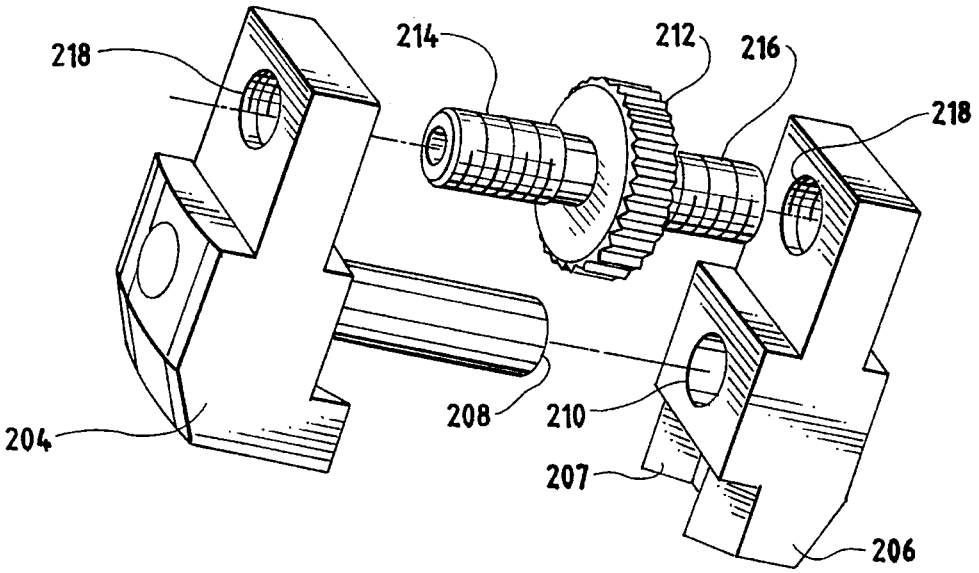
FIG. 20 is and exploded view showing the interaction between the positionable jaws, guide pin, and thumb wheel.

The positionable jaws of the present invention may also be used to form an adjustable ratchet wrench. As illustrated in FIGS. 18 through 20, this embodiment includes fixed handle 200 having head 201 which contains a ratchet mechanism 202 which persons of ordinary skill in the art would recognize could encompass a wide number of workable designs. Opposingly located within head 201 are first jaw 204 and second jaw 206, having jaw surfaces 207 which are configured and positioned relative one another and linear axis 211. The jaws, again, will be able to accommodate and engage five full sides of the smallest fastener within the operating range of the tool and at least four full sides of any subsequently larger fastener within the operating range of the tool so long as the jaws are configured and positioned relative to one another and linear axis 211 as was described above.

Linear alignment of jaws 204 and 206 along axis 211 is maintained by guide pin 208 which is integral with jaw 204 and slidably received by bore 210 of jaw 206. The jaws are adjusted by rotating thumb wheel 212 having threaded shafts 214 and 216 which engage correspondingly positioned internally threaded holes 218 which are also located in jaws 204 and 206. The rotation of wheel 212 causes shafts 214 and 216 to rotate, and their interaction with threaded holes 218 adjustingly positions the jaws.

While the preferred embodiments of the present invention have been illustrated and described, it will be understood by those of ordinary skill in the art that changes and other modifications may be made without departing from the invention in its broader aspects. Accordingly, persons of ordinary skill in the art would also understand that the invention would not be limited to the type of tool or wrench the jaws of the present invention are used with, and that any tool, whether pivoting, adjustable, ratcheting, or of some other design, would be within the scope of the present invention.

What is claimed is:

1. A tool having positionable jaws for engaging various sized hexagonally shaped objects within the operating range of said tool, comprising:

a first jaw and an opposingly positioned second jaw, said second jaw being positionable relative to said first jaw on a linear axis;

said first jaw having three angularly disposed jaw surfaces comprising a base surface, an intermediate surface and an extended surface;

said second jaw having two angularly disposed jaw surfaces comprising a base surface and extended surface;

said base jaw surface of said first jaw forms an angle of about 19 degrees with said linear axis; and said first and second jaw surfaces having a configuration and being positioned relative to one another and said linear axis such that said jaw surfaces have the ability to operatively engage five full sides of an object when in a closed position and at least four full sides of a hexagonally shaped object, when in an open position, by specifically engaging three adjacent sides and one opposing side of said hexagonally shaped objects within said operating range of said tool.

2. The tool of claim 1 wherein said tool further includes an adjustment means for positioning said jaws.

3. A tool having positionable jaws for engaging various sized hexagonally shaped objects within the operating range of said tool, comprising:

a first jaw and an opposingly positioned second jaw, said second jaw being positionable relative to said first jaw on a linear axis;

said first jaw having three angularly disposed jaw surfaces comprising a base surface, an intermediate surface and an extended surface;

said second jaw having two angularly disposed jaw surfaces comprising a base surface and extended surface; and said base jaw surface of said first jaw forms an angle of about 19 degrees with said linear axis whereby said jaw surfaces have the ability to operatively engage at least four full sides of hexagonally shaped objects within said operating range of said tool.

4. The tool of claim 3 wherein said tool further includes an adjustment means for positioning said jaws.

5. A tool having positionable jaws for engaging various sized hexagonally shaped objects within the operating range of said tool, comprising:

a first jaw and an opposingly positioned second jaw, said second jaw being positionable relative to said first jaw on a linear axis;

said first jaw having three angularly disposed jaw surfaces comprising a base surface, an intermediate surface and an extended surface;

said base jaw surface of said first jaw forms an angle of about 19 degrees with said linear axis;

said second jaw having two angularly disposed jaw surfaces comprising a base surface and extended surface; and said jaw surfaces are configured wherein the length of said intermediate jaw surface plus the length of said base jaw surface of said first jaw is equal to twice the length of said base jaw surface of said second jaw.

* * * * *